United States Patent [19]

Michaud

[11] Patent Number: 4,740,712

[45] Date of Patent: Apr. 26, 1988

[54] TRUCK BOOM COMMANDER

[76] Inventor: Fernand Michaud, 450 Route 203, Hauelock, Hemmingford, Que., Canada

[21] Appl. No.: 809,244

[22] Filed: Dec. 16, 1985

[51] Int. Cl.[4] ..... B66C 13/40

[52] U.S. Cl. ..... 307/149; 307/147; 340/685; 361/342; 361/394; 212/160

[58] Field of Search ..... 307/116, 147, 149, 150; 361/334–365, 391–397, 399; 212/124, 126, 131, 125, 153, 179, 160–165, 187, 180, 181, 189, 182, 214, 215, 216, 159, 160; 414/273, 279, 269, 281, 284, 338, 334, 337, 636, 499, 674; 174/28, 107, 110 FC, 113 C, 113 R, 115; 455/347, 128, 90; 182/2, 19, 148; 109/49.5, 53, 55, 58, 78; 340/685

[56] References Cited

U.S. PATENT DOCUMENTS

| | | | |
|---|---|---|---|
| Re. 31,539 | 3/1984 | Spalluto | 212/160 |
| 976,067 | 11/1910 | Gilmore | 109/53 |
| 2,076,085 | 4/1937 | Hunnicutt | 109/55 X |
| 2,613,623 | 10/1952 | Behrens | 109/58 |
| 3,321,672 | 5/1967 | Kuhn et al. | 361/340 |
| 3,633,075 | 1/1972 | Hawkins | 361/344 |
| 3,708,077 | 1/1973 | Richens et al. | 414/281 X |
| 3,762,787 | 10/1973 | Grubb | 312/214 |
| 3,774,217 | 11/1973 | Bonner et al. | 212/160 X |
| 3,858,728 | 1/1975 | Fathauer | 212/160 |
| 4,012,089 | 3/1977 | Ward | 312/214 X |
| 4,090,230 | 5/1978 | Fuller et al. | 361/345 |
| 4,126,232 | 11/1978 | Orawiec | 212/205 |
| 4,178,624 | 12/1979 | Wilson et al. | 361/342 X |
| 4,180,846 | 12/1979 | Wilson et al. | 361/342 X |
| 4,249,227 | 2/1981 | Kato et al. | 361/334 |
| 4,305,114 | 12/1981 | Takagi et al. | 361/391 X |
| 4,307,810 | 12/1981 | Spalluto | 212/160 X |
| 4,399,487 | 8/1983 | Neumann | 361/394 X |
| 4,441,766 | 4/1984 | Hess | 312/214 |
| 4,463,408 | 7/1984 | Kleinecke et al. | 361/342 |
| 4,479,263 | 10/1984 | Rosenfeldt et al. | 361/394 X |
| 4,626,048 | 12/1986 | Goodlander | 312/214 X |

*Primary Examiner*—William M. Shoop, Jr.
*Assistant Examiner*—Paul Ip
*Attorney, Agent, or Firm*—Chilton, Alix & Van Kirk

[57] ABSTRACT

A housing for a command system for cranes, derricks or the like, includes an inner enclosure disposed within an outer enclosure with insulating spaces therebetween. Both the inner and outer enclosures are made of an insulating material. The inner enclosure includes compartments which receive modules in a drawer-like manner.

5 Claims, 4 Drawing Sheets

TRUCK BOOM COMMANDER

BACKGROUND OF INVENTION

1. Field of the Invention

The invention relates to a command system for cranes, derricks or the like. More specifically, the invention relates to a protective housing for such a system.

2. Description of Prior Art

It is known in the art to provide remote control systems of the above nature. Such systems are described in, for example, U.S. Pat. Nos. 4,307,810, Spalluto, Dec. 29, 1981, 3,774,217, Bonner et al Nov. 20, 1973, and 3,858,728, Fathauer, Jan. 7, 1975.

The Bonner et al and the Fathauer patents teach radio controlled such systems.

The receiver units of such systems are subject to deterioration due to the conditions in which they are operated. In addition, they are subject to failure under extreme weather conditions.

SUMMARY OF INVENTION

It is therefore an object of the invention to provide a system which overcomes the above disadvantages.

It is a more specific object of the invention to provide a protective housing for such a system.

In accordance with the invention, the housing includes an inner enclosure disposed within an outer enclosure with insulating spaces therebetween. The inner enclosure includes compartments which receive modules in a drawer-like manner.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
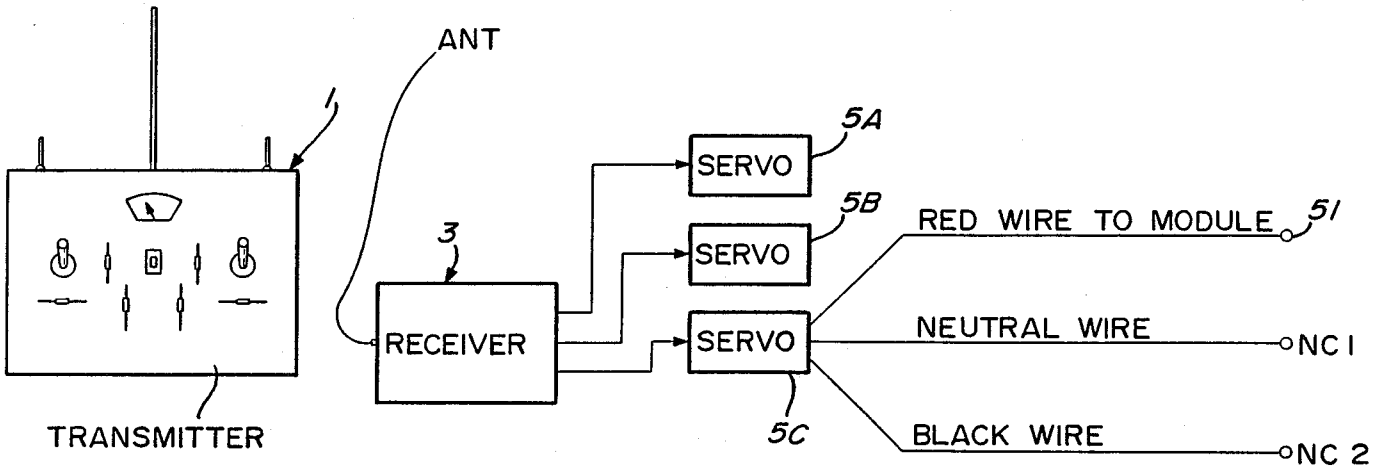
FIG. 1 is a schematic drawing of the entire system.

Referring to FIG. 1, the system includes a multi-channel transmitter 1. In a preferred embodiment, the transmitter is a Futaba Company FM transmitter FP-T7FG/K-72400 MHz. The transmitter is used to transmit control signals from a location remote from the crane, derrick or the like. In the illustrated embodiment, the transmitter is a seven channel transmitter.

A multi-channel receiver 3 is mounted on the crane or derrick carrier as will be seen below. In a particular embodiment, the crane is mounted on a truck, and the receiver is mounted in an enclosure on the truck.

The outputs of the receiver are connected to servos 5A, 5B, 5C . . . In the present embodiment, there are seven such servos, and each channel is connected to a different servo. The outputs of the servos then drive respective relays as will also be seen beolw.

Figure 2:
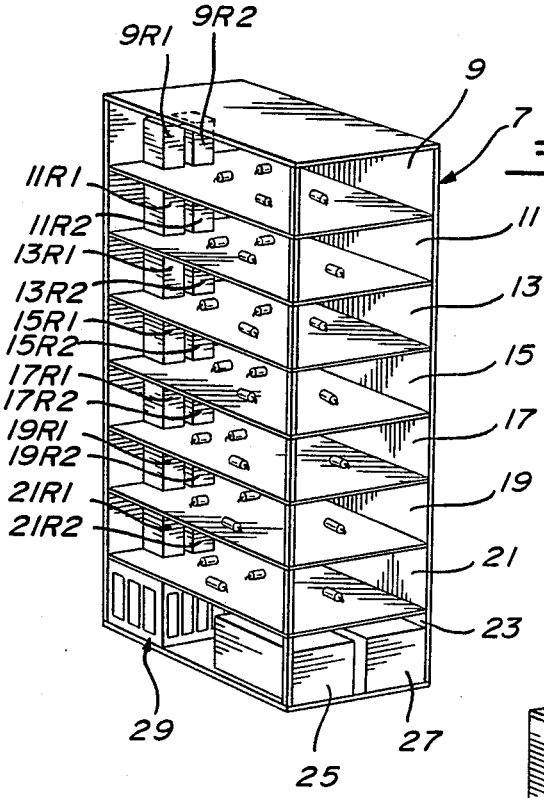
FIG. 2 is a perspective view of the inner enclosure.

Turning now to FIG. 2, the housing includes an inner enclosure 7 having a plurality of compartments 11, 13, 15, 17, 19, 21, and 23. Each compartment receives a separate module in a drawer-like manner. In the illustrated embodiments, each module comprises a pair of relays 9R1, 9R2, to 21R1, 21R2 and associated electronic circuitry. The bottom compartment 23 houses the radio receiver 25, a power supply 27, and the seven servos illustrated generally at 29.

The inner enclosure has a plurality of walls (six in the illustrated embodiment) and is dimensioned to be disposed in an outer enclosure 31 illustrated in walls, and is dimensioned so that there is an insulating space between each wall of the inner enclosure and the corresponding wall of the outer enclosure. The insulating space could be, for example, ¼ inch. However, the space 37 between the rear walls of the inner and outer enclosures will normally be greater than the insulating spaces so that wiring could be disposed in this back space.

One of the walls 33 of the outer enclosure 31 is an openable wall, that is, it can be either a door or a removable wall. The wall 33 is opened to permit insertion of the inner enclosure into the outer enclosure. The inner enclosure will be disposed in the outer enclosure such that individual ones of the modules could be removed from the inner enclosure through the openable wall without removing the inner enclosure from the outer enclosure.

Foam rubber pads 35 or the like could be included in the insulating spaces for shock absorption purposes. Mounting bolts 37 extend outwardly of the rear wall of the outer enclosure.

Figure 4:
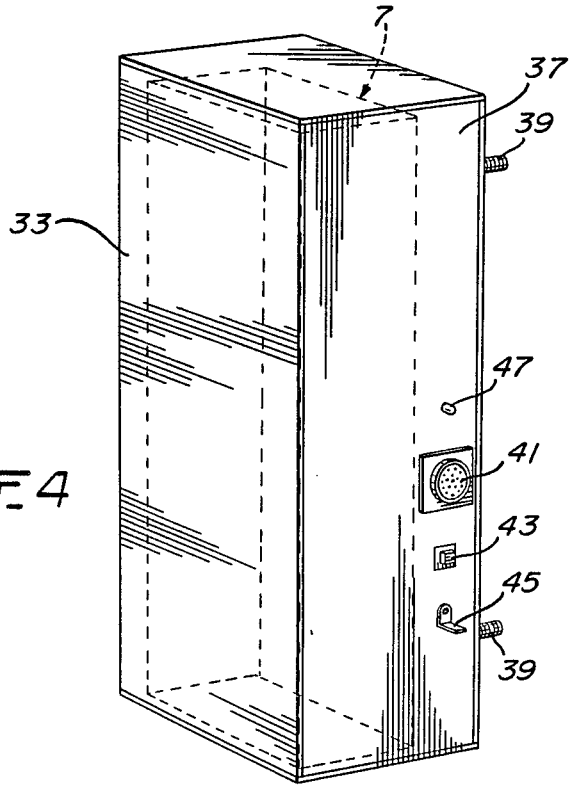
FIG. 4 is a perspective rear view of the outer enclosure.

Mounted on the rear wall of the outer enclosure, as seen in FIG. 4, are a main wire connector 41, a push-/pull ON/OFF switch 43, a grounding lead 45 and a red LED indicator 47.

Figure 5:
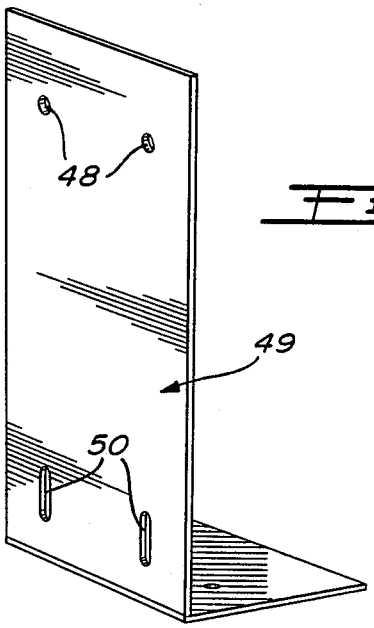
FIG. 5 illustrates a plate for mounting the enclosure.

The assembled enclosure is preferably mounted on an angled plate 49 as shown in FIG. 5. The mounting bolts will extend through respective ones of the holes 48 or the slotted openings 50.

Figure 6:
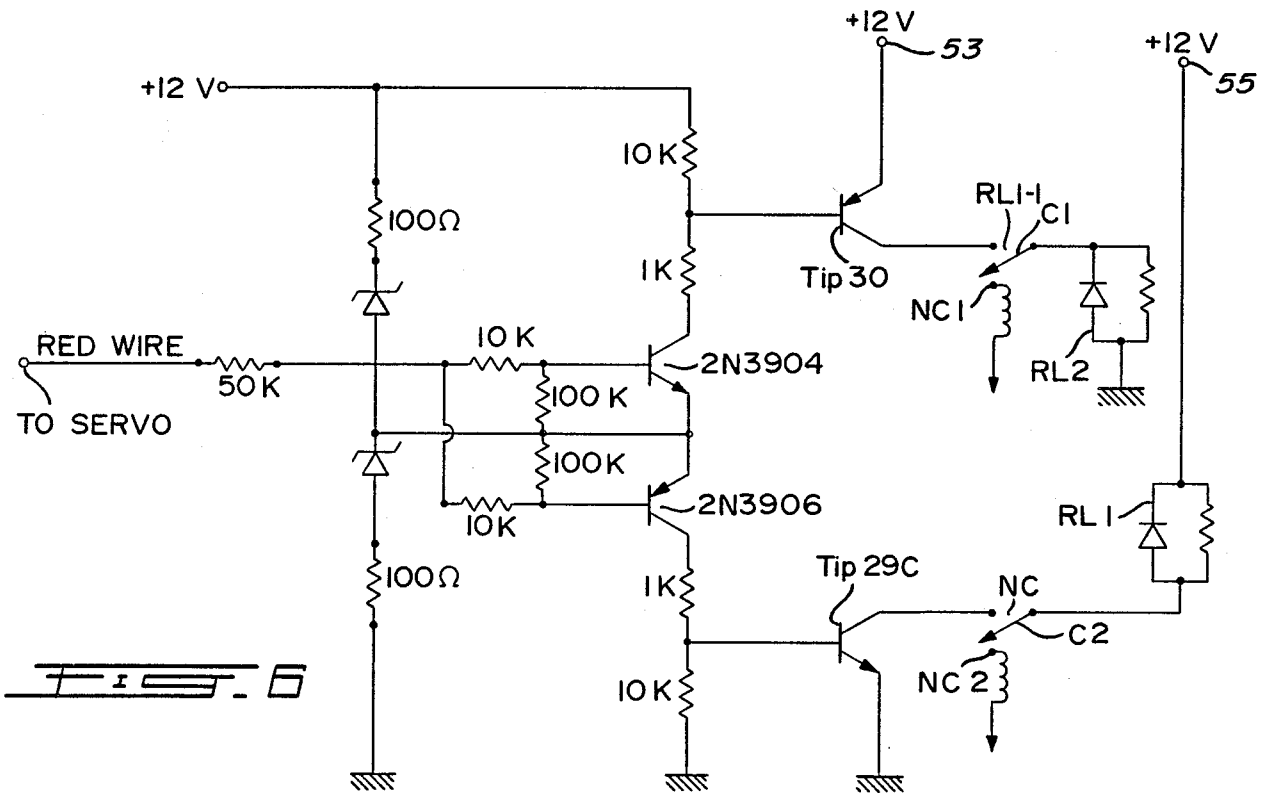
FIG. 6 is a circuit diagram of the electric circuitry associated with each module.

FIG. 6 illustrates the electronic circuitry included in each module. Considering FIG. 6 together with FIG. 1, lead 51 of a respective servo is connected to lead 51 of the electronic circuitry. Lead NC1 is connected to coil NC1 of one of the relays in the module, and lead NC2 is connected to coil NC2 of the other one of the relays in the module. When an appropriate signal is emitted by the servo, contact C1 or C2 will close whereby to provide power at output terminal 53 or output terminal 55. The output terminals are connected to the output connector 41 of FIG. 4.

Figure 3:
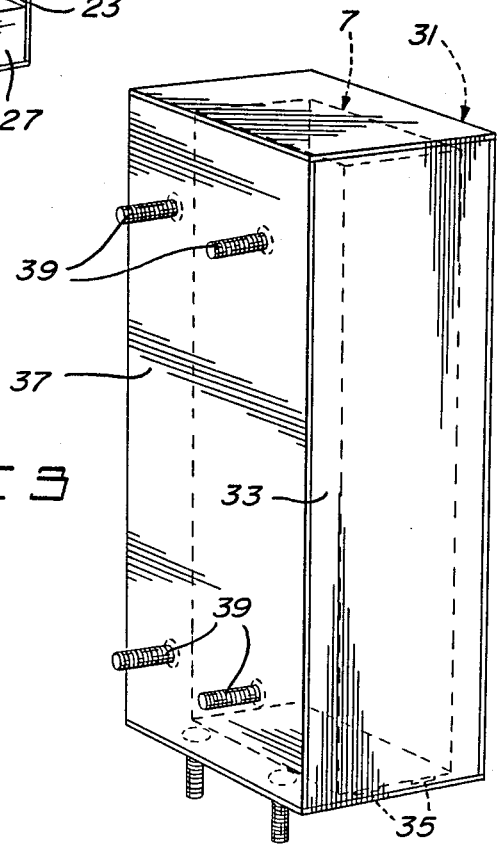
FIG. 3 is a perspective side view of the outer enclosure.

Each module is associated with a different function of the crane, and the connector 41 receives leads from solenoids which actuate the hydraulic valves which control the motors or the like for providing the function. Thus, if the electronic circuit illustrated in FIG. 3 was to control the raising or lowering of the boom, then lead 53 would be connected, through the connector 41, to the solenoid on the hydraulic valve which controls the motor for raising the boom, and lead 55 would be connected to th solenoid on the hydraulic valve which controls the motor for lowering the boom.

It can be seen that the housing will protect the relays and electornic circuitry from the deteriorating influences of the environment in which the crane must operate. In addition, because the inner and outer enclosures are made of an insulating material, for example, a plexiglass material, and because there are insulating spaces between the walls of the inner and outer enclosures, the elements of the modules will also be protected from extreme changes in temperature. Accordingly, the system will be usable under conditions of unfavourable environment and within a large range of temperature.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A protective housing for a command system for a crane or derrick or the like, comprising:

an outer enclosure including a plurality of walls and formed of an insulating material, one of said walls being openable;

an inner enclosure, having a like plurality of walls, disposed in said outer enclosure such that each wall of said inner enclosure is spaced from a corresponding wall of said outer enclosure whereby there is insulating space between each wall of the inner enclosure and the corresponding wall of the outer enclosure;

said inner enclosure comprising a plurality of compartments, each compartment receiving a separate module, each said module being associated with a different function of said crane; and output connector means for connecting the modules to respective control means for controlling the crane functions.

2. A housing as defined in claim 1 wherein said crane or derrick is carried by a truck, and further including plate means mounted on the truck for mounting the enclosures.

3. A housing as defined in claim 1 wherein said openable wall comprises a door.

4. A housing as defined in claim 1 and including insulating pads in said insulating spaces.

5. A housing as defined in claim 1 wherein said inner enclosure and said outer enclosure comprise a plexiglass material.

* * * * *